US007993073B2

(12) United States Patent
Ryu

(10) Patent No.: US 7,993,073 B2
(45) Date of Patent: Aug. 9, 2011

(54) ROAD MARKER

(76) Inventor: Ji Hyun Ryu, Incheon (KR)

( * ) Notice: Subject to any disclaimer, the term of this patent is extended or adjusted under 35 U.S.C. 154(b) by 247 days.

(21) Appl. No.: 12/473,498

(22) Filed: May 28, 2009

(65) Prior Publication Data

US 2009/0297264 A1 Dec. 3, 2009

(30) Foreign Application Priority Data

May 29, 2008 (KR) ..... 10-2008-0050001
May 6, 2009 (KR) ..... 10-2009-0039315

(51) Int. Cl.
*E01F 9/00* (2006.01)
*E01F 9/06* (2006.01)

(52) U.S. Cl. ..... 404/11; 404/16

(58) Field of Classification Search ..... 404/9–16; 116/63 R
See application file for complete search history.

(56) References Cited

U.S. PATENT DOCUMENTS 2,157,059 A * 5/1939 Rosener ..... 404/11
3,292,506 A * 12/1966 Kone ..... 404/11
4,737,049 A * 4/1988 Callhan ..... 359/551
4,955,982 A * 9/1990 Paulos ..... 404/11
5,302,048 A * 4/1994 Paulos et al. ..... 404/11
5,895,170 A * 4/1999 Chambers et al. ..... 404/10
6,062,766 A * 5/2000 Fleury et al. ..... 404/11
6,478,506 B1 * 11/2002 Figlewicz et al. ..... 404/11
6,726,399 B2 * 4/2004 Heeks et al. ..... 404/15
7,507,052 B2 * 3/2009 Griffiths ..... 404/11

FOREIGN PATENT DOCUMENTS

KR 10-0819688 B1 4/2008

* cited by examiner

*Primary Examiner* — Thomas B Will
*Assistant Examiner* — Abigail A Risic
(74) *Attorney, Agent, or Firm* — Schwegman, Lundberg & Woessner, P.A.

(57) ABSTRACT

A road marker according to exemplary embodiments of the present invention has advantages that exterior impact transmitted from a tire may be absorbed by elastic force of a spring as a consequence of a transparent cover being completely inserted in an upper housing when a vehicle passes on a road marker. The road marker has further advantages in that a vehicle load may not be transmitted to a guide cover and thus breakage of the road marker may be prevented.

15 Claims, 12 Drawing Sheets

ROAD MARKER

CROSS-REFERENCE TO RELATED APPLICATION

This application claims priority to and the benefit of Korean Patent Applications No. 10-2008-0050001 and No. 10-2009-0039315 filed in the Korean Intellectual Property Office respectively on May 29, 2008 and May 6, 2009, the entire contents of which are incorporated herein by reference.

BACKGROUND OF THE INVENTION (a) Field of the Invention

The present invention relates to a road marker. More particularly, the present invention relates to a road marker that is laid under a road and is used for identifying a lane and for guiding a driver at night through self-emission.

(b) Description of the Related Art

Generally, center lines, lane-dividing lines, or safety-dividing lines are drawn on roads for limiting and guiding a driving range of vehicles, and road markers are mounted on such lines for preventing vehicles from lane crossover as a consequence of dozing off while driving or inexperienced driving.

The road marker includes a support laid under a road surface and a main body integrally combined to the support, protruded from the road surface with an even space, and provided with a reflector for reflecting light of a headlight.

However, since a conventional road marker is integrally fixed to the support laid under the road surface and is protruded from the road surface, the conventional road marker cannot efficiently disperse external impact, that is, load applied when vehicle passes thereon. Therefore, the conventional road marker may be often destroyed.

Since the support fixed under the road must be dug out for repairing a road marker that is destroyed by external impact, excessive time and cost may be required and it may cause a heavy traffic jam.

Furthermore, strong impact may be directly applied to a vehicle body when a vehicle wheel passes on the road marker, and thereby drivers may be startled and this may cause serious accidents. Thus, the conventional road marker cannot play its role.

Also, since visibility of the conventional road marker is deteriorated at night, the conventional road marker cannot play its role at night.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a road marker having advantages of improving durability as a consequence of absorbing impact transmitted from a tire when a vehicle passes thereon and preventing load of a vehicle from being transmitted to a guide cover.

In addition, another objective of the present invention is that inflow of water to a gap between an upper housing and a slider, and accordingly breakage of a road marker, are prevented.

A road marker according to the first exemplary embodiment of the present invention may include: an upper housing having a cylindrical shape, and having a wing portion formed along an upper exterior circumference thereof and receiving a reflector and a guiding surface formed as a stepped surface from a lower interior circumference thereof; a slider having a cylindrical shape, and having a socket housing disposed inside thereof and integrally formed with an upper end thereof, a seal mounted along an upper exterior circumference thereof and contacting an interior circumference of the upper housing, and a stopping protrusion formed along a lower exterior circumference thereof so as to be guided along the guiding surface, the slider being inserted into and being slidably mounted in the upper housing; a storage battery case mounted in the socket housing; a transparent cover including a rounded upper surface and a frame insert groove having a predetermined shape and formed along the upper surface thereof, the transparent cover being engaged to an upper circumference of the slider; a reinforcing frame having a predetermined shape and insertedly mounted in the frame insert groove of the transparent cover; a guide cover disposed at a lower portion of the upper housing, and having a penetration hole formed at a middle portion thereof, a cylindrical guider formed upwardly at an upper circumference of the penetration hole and guiding the interior circumference of the slider, and a plurality of air holes formed along a circumference of the cylindrical guider; a lower housing having a cylindrical shape opened upwardly, and having a mounting end integrally formed with a mounting groove formed inwardly at an upper exterior circumference thereof so as to be engaged to the lower portion of the upper housing together with the guide cover, a barrier rib formed therein and partitioned into an inner chamber and an outer chamber in which a predetermined negative pressure is generated, and check valves corresponding respectively to the inner chamber and the outer chamber mounted at a lower surface thereof; a sealing tube formed as a rubber tube with a bellows shape, and having an upper end sealingly mounted at the socket housing of the slider together with the storage battery case through the penetration hole of the guide cover, an extended end formed at one side of an external circumference thereof and insertedly mounted between the lower housing and the lower surface of the guide cover, and an air pathway formed along an edge of the extended end and corresponding to the air hole; a spring, in the upper housing, interposed between the lower surface of the socket housing and a spring support surface in the cylindrical guider of the guide cover, and exerting elastic restoring force on the slider; and light emitting means mounted on the slider, supplying electric power charged in a solar cell module to a light emitting element, and emitting light to the exterior through a transparent cover.

The reflector may have a surface with high luminance and reflection characteristics, and may be mounted through extended portions formed respectively at both sides of the wing portion corresponding to a driving direction of a vehicle.

The seal may have three contact lines formed along the exterior circumference thereof and contacts the interior circumference of the upper housing.

A sliding stroke of the slider may be longer than the height of the transparent cover.

An air gap for passing air may be formed between the exterior circumference of the cylindrical guider and the interior circumference of the slider corresponding thereto.

The reinforcing frame may include a circular ring portion insertedly mounted in the exterior circumference of the transparent cover, and a frame portion integrally connected to the ring portion and insertedly mounted in the frame insert groove formed across the upper surface of the transparent cover.

The check valve may include: a valve housing having an outlet formed toward the inside of the lower housing; a check ball inserted in the valve housing corresponding to the outlet; a valve cover engaged to a lower portion of the valve housing, and having a supporting protrusion integrally formed at a middle portion thereof and supporting the check ball, and a penetration hole formed therein; and a valve spring, in the valve housing, supporting the check ball toward the outlet with respect to the valve cover.

The sealing tube may include: an upper tube portion disposed in the cylindrical guider of the guide cover, an upper end of the upper tube portion being sealingly mounted to the socket housing of the slider together with the storage battery case; and a lower tube portion integrally formed with a lower portion of the upper tube portion, disposed in the inner chamber of the lower housing, and having an extended end formed at one side of the external circumference thereof connected to the upper tube portion so as to be insertedly mounted between an upper end of the barrier rib in the lower housing and a lower surface of the guide cover, the lower tube portion having a wider width than the upper tube portion.

The light emitting means may include: a solar cell module having a plurality of storage batteries mounted in the storage battery case, and a control circuit disposed at the upper end of the slider and charging the storage battery by using solar energy; a plurality of light emitting elements mounted at a middle upper surface of the solar cell module and emitting light according to a control signal; and an illuminance meter mounted at one side of the upper surface of the solar cell module, detecting illuminance, and outputting a signal corresponding thereto to the solar cell module.

A road marker according to the second exemplary embodiment of the present invention may include: an upper housing having a cylindrical shape, and having a wing portion formed along an upper exterior circumference thereof and receiving a reflector and a guiding surface formed as a stepped surface from a lower interior circumference thereof; a slider having a cylindrical shape and having an opened upper surface, and having a stopping protrusion formed along a lower exterior circumference and guiding the guiding surface, and a socket housing formed at a middle portion thereof and having a space so as to be inserted into and slidably mounted in the upper housing; a transparent cover having a rounded upper surface and engaged to an upper circumference of the slider; a guide cover disposed at a lower portion of the upper housing, and having a penetration hole formed at a middle portion thereof and a cylindrical guider formed upwardly at an upper circumference of the penetration hole and guiding the interior circumference of the slider; a lower housing having a cylindrical shape opened upwardly, and having an air hole formed at a lower surface thereof and a mounting end protruded outwardly along an upper circumference so as to be engaged to the lower end of the upper housing together with the guide cover; a sealing tube formed as a rubber tube with a bellows shape opened upwardly, and having an upper end sealingly mounted at the lower surface of the socket housing through the penetration hole of the guide cover by means of a mounting ring and an extended end formed at one side of the external circumference thereof and engaged between the mounting end of the lower housing and the lower surface of the guide cover; a spring, in the upper housing, interposed between the lower surface of the socket housing and an upper surface of the cylindrical guider, and exerting elastic restoring force on the slider; and light emitting means mounted on the slider, supplying electric power charged by using solar energy to a light emitting element, and emitting light to the exterior through the transparent cover.

The sealing tube may include: an upper tube portion disposed in the cylindrical guider of the guide cover and having an upper end sealingly mounted at the lower surface of the socket housing through the mounting ring; and a lower tube portion integrally formed with a lower portion of the upper tube portion, disposed in the lower housing, and having the extended end formed at one side of the external circumference thereof connected to the upper tube portion so as to be engaged between the mounting end of the lower housing and the lower surface of the guide cover.

The light emitting means may include: a storage battery mounted at the space in the socket housing of the slider; a control circuit board disposed in the space of the socket housing and disposed at an upper portion of the storage battery; a solar panel mounted at an upper portion of the socket housing and charging the storage battery by using solar energy; the light emitting element mounted on the control circuit board through the solar panel; and an illuminance meter mounted at one side of the upper surface of the solar panel, detecting illuminance, and outputting a signal corresponding thereto to the control circuit board.

The reflector may have a surface with high luminance and reflection characteristics, and may be mounted through extended portions formed at the wing portion corresponding to a driving direction of a vehicle.

A seal may be mounted at the stopping protrusion of the slider for maintaining air-tightness between the stopping protrusion and the guiding surface of the upper housing.

The spring may be disposed in the cylindrical guider of the guide cover, and may have a lower end supported by the upper surface of the guide cover and an upper end supported by the lower surface of the slider.

DETAILED DESCRIPTION OF THE EMBODIMENTS

Hereinafter, exemplary embodiments of the present invention will be described in detail with reference to the accompanying drawings.

Figure 1:
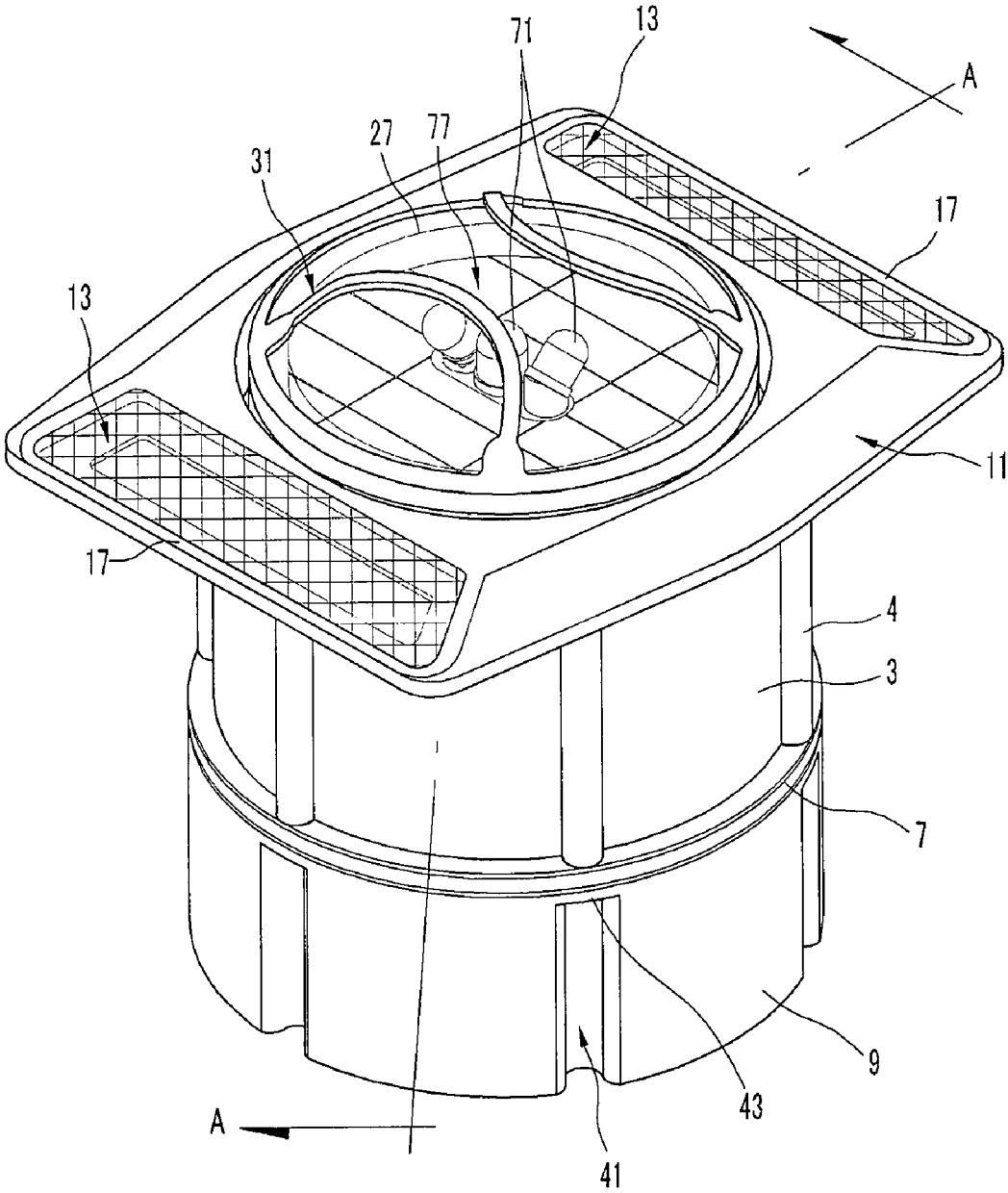
FIG. 1 is a perspective view of a road marker according to the first exemplary embodiment of the present invention.
Figure 2:
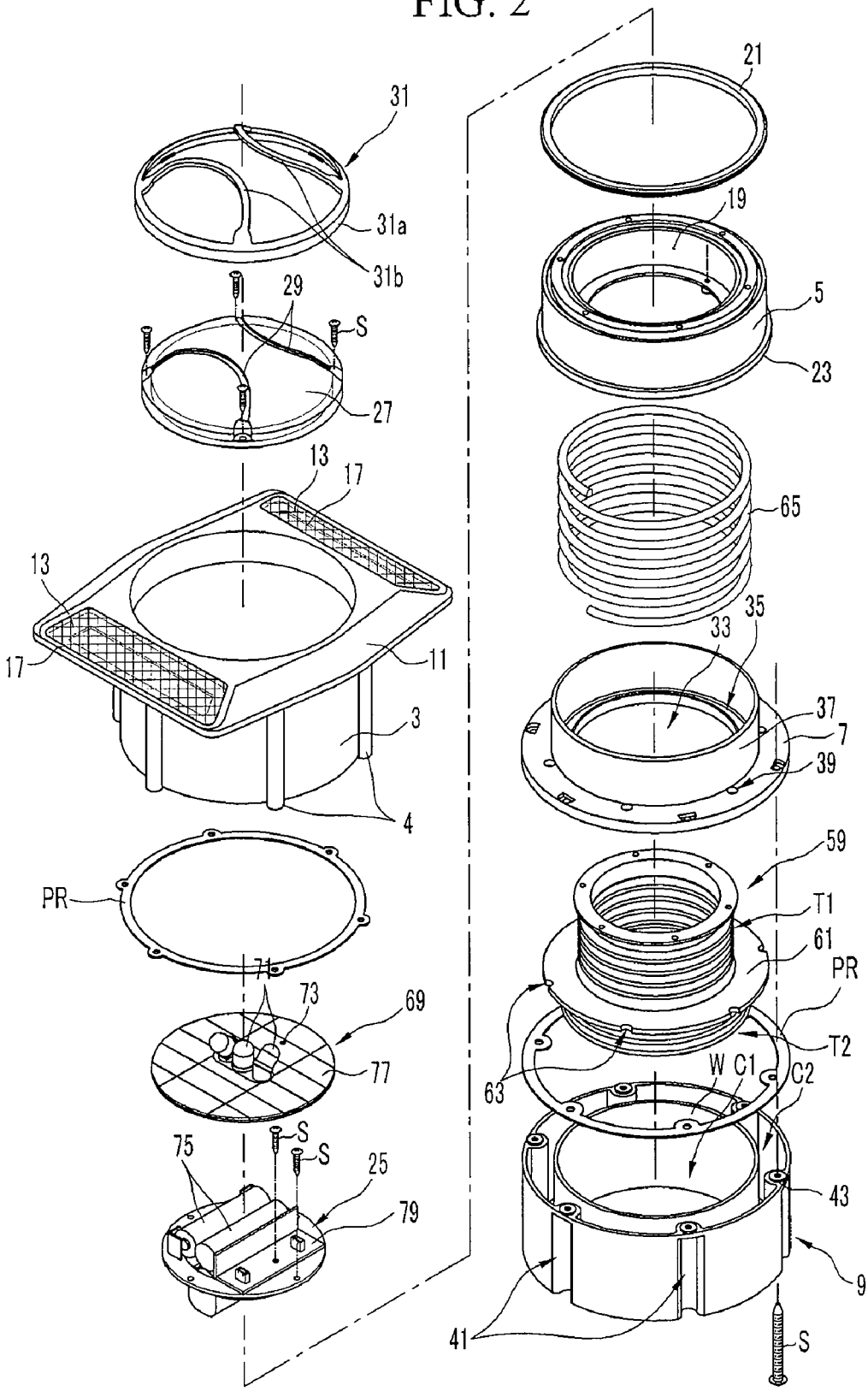
FIG. 2 is an exploded perspective view of a road marker according to the first exemplary embodiment of the present invention.
Figure 3:
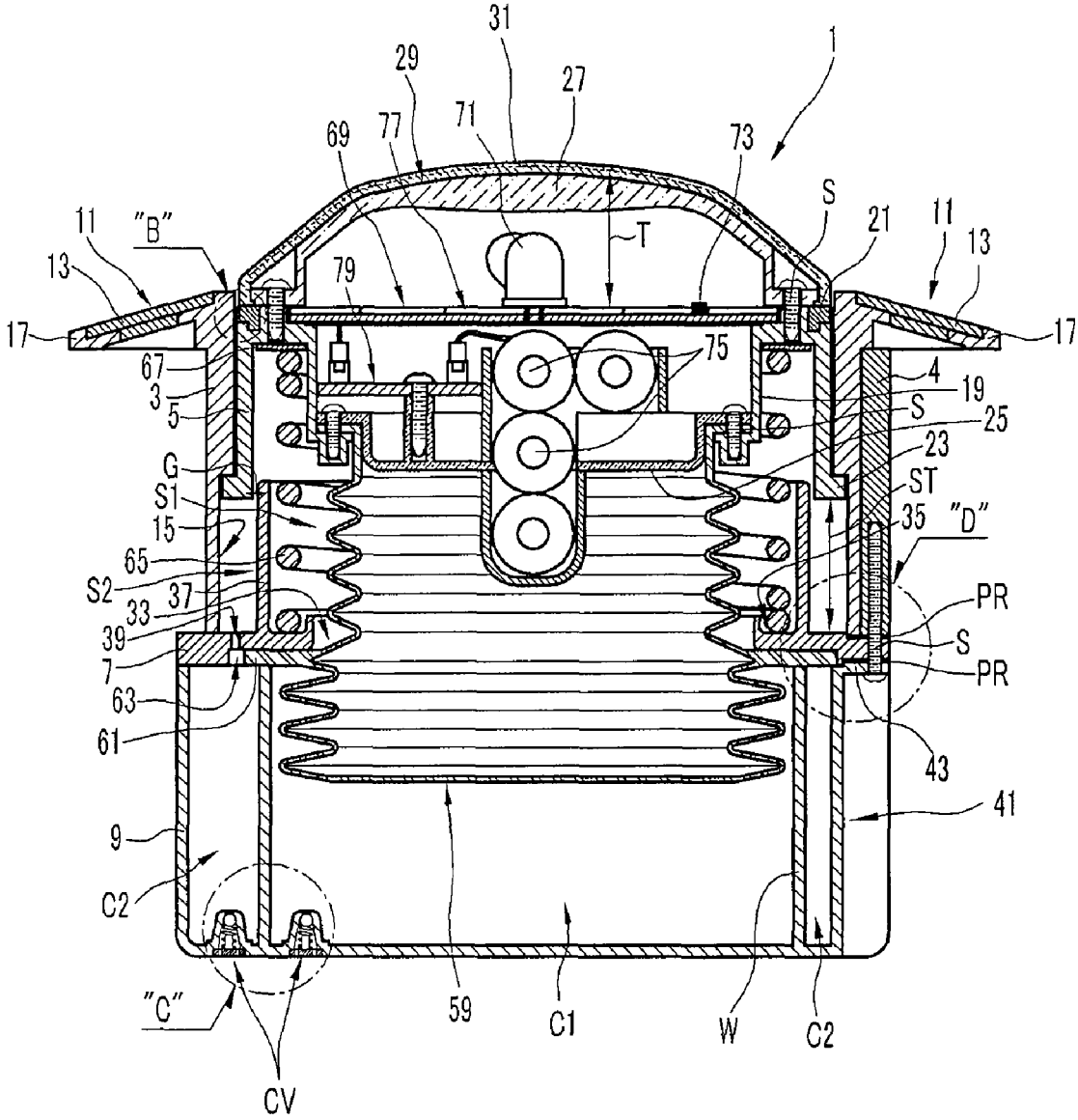
FIG. 3 is a cross-sectional view taken along the line A-A in FIG. 1.

FIG. 1 is a perspective view of a road marker according to the first exemplary embodiment of the present invention, FIG. 2 is an exploded perspective view of a road marker according to the first exemplary embodiment of the present invention, and FIG. 3 is a cross-sectional view of a road marker according to the first exemplary embodiment of the present invention.

A road marker 1 according to the first exemplary embodiment of the present invention, as shown in FIG. 1 and FIG. 2, includes an upper housing 3 laid under a road surface, a slider 5 sliding upwardly and downwardly in the upper housing 3, a guide cover 7 guiding upward and downward movements of the slider 5, and a lower housing 9 engaged to a lower portion of the upper housing 3.

The upper housing 3, as shown in FIG. 3, has a cylindrical shape and has six screw engaging portions 4 formed along an exterior circumference thereof. A wing portion 11 in which a reflector 13 is mounted and that is a reference surface is formed at an upper exterior circumference of the upper housing 3, and a guiding surface 15 that is an outward stepped surface from an interior circumference of the upper housing 3 is formed at a lower interior circumference thereof.

Herein, the reflector 13 has a surface with high luminance and reflection characteristics, and is mounted on an extended portion 17 formed at the wing portion 11 corresponding to a driving direction of a vehicle.

In addition, the slider 5 has a cylindrical shape, and has a socket housing 19 disposed in the slider 5 and integrally formed with an upper end of the slider 5.

A seal 21 contacting the interior circumference of the upper housing 3 is insertedly mounted in the upper exterior circumference of the slider 5.

Figure 4:
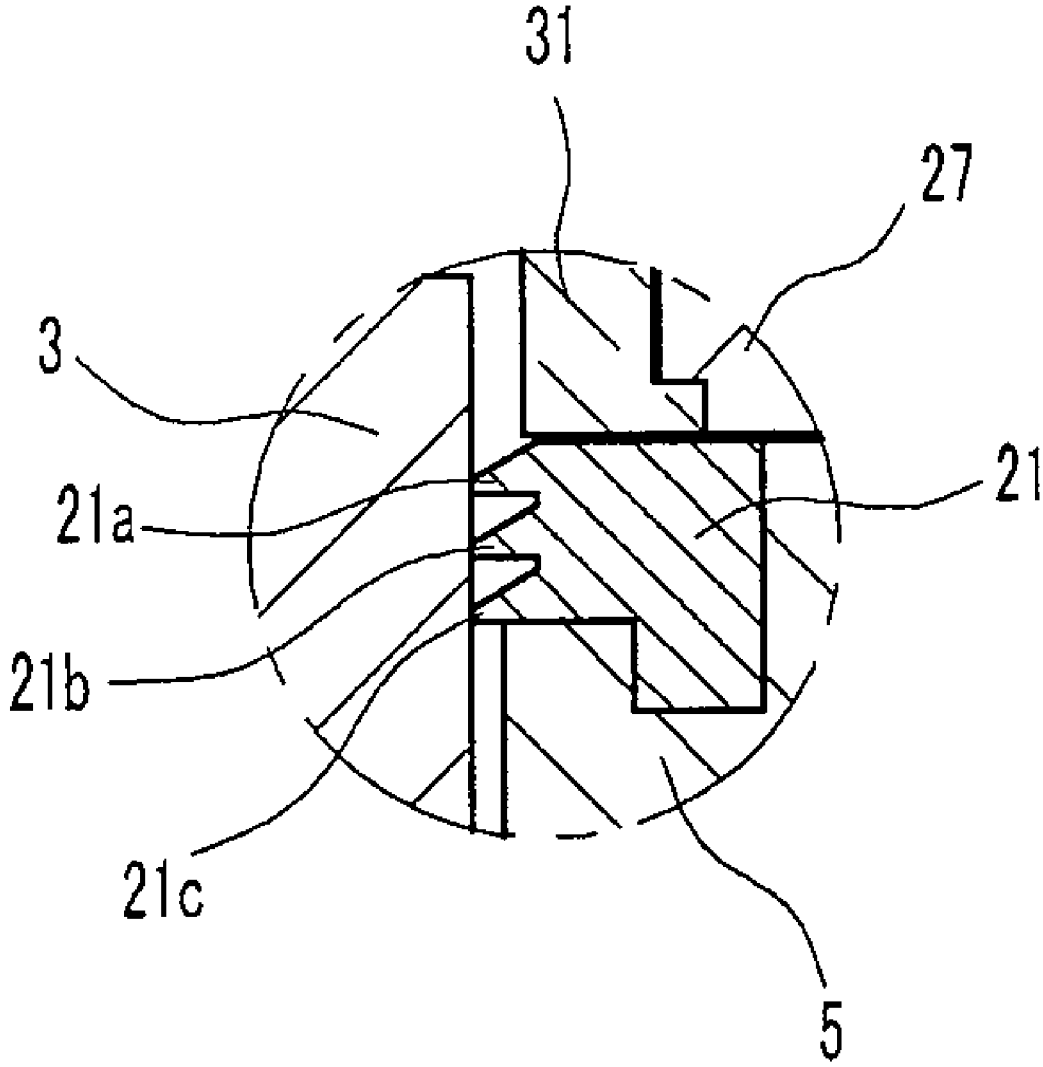
FIG. 4 is an enlarged cross-sectional view of a "B" portion in FIG. 3.

Herein, the seal 21, as shown in FIG. 4, has three contact lines 21*a*, 21*b*, and 21*c* formed along the exterior circumference thereof and contacts to the interior circumference of the upper housing 3 along three lines.

In addition, a stopping protrusion 23 is integrally formed along the lower exterior circumference of the slider 5 so as to be guided by the guiding surface 15. Therefore, the slider 5 is inserted in the lower end of the upper housing 3 and slides upwardly and downwardly in the upper housing 3.

Herein, a storage battery case 25 is engaged in the socket housing 19 by screws S.

In addition, a transparent cover 27 is mounted on the slider 5. The transparent cover 27 is made of transparent plastic materials and has a rounded upper surface. The transparent cover 27 is engaged to an upper circumference of the slider 5 by four screws S.

At this time, a lower edge of the transparent cover 27 supports the upper surface of the seal 21 so as to fix the seal 21 on the slider 5, as shown in FIG. 4.

Herein, the height T of the transparent cover 27 is shorter than the sliding stroke ST of the slider 5.

In addition, a frame insert groove 29 of a predetermined shape is formed along the upper surface of the transparent cover 27, and a reinforcing frame 31 having the same shape as the frame insert groove 29 is insertedly mounted in the frame insert groove 29.

At this time, the reinforcing frame 31 is made of metallic materials having sufficient strength, and includes a circular ring portion 31*a* insertedly mounted in the exterior circumference of the transparent cover 27 and a frame portion 31*b* integrally connected to the ring portion 31*a* and insertedly mounted in the frame insert groove 29 formed across the upper surface of the transparent cover 27, as shown in FIG. 2.

In a state in which the reinforcing frame 31 is mounted on the transparent cover 27, the ring portion 31*a* covers the screws S for engaging the transparent cover 27 to the slider 5 such that the screws S are not exposed.

In addition, the guide cover 7 as well as the lower housing 9 is mounted at a lower portion of the upper housing 3 by interposing packing rings PR for maintaining air-tightness. A penetration hole 33 is formed at a middle portion of the guide cover 7, and a cylindrical guider 37 provided with a spring support surface 35 is formed upwardly at a circumference of the penetration hole 33. The cylindrical guider 37 guides the interior circumference of the slider 5.

At this time, an air gap G for passing air is formed between the exterior circumference of the cylindrical guider 37 and the interior circumference of the slider 5 corresponding thereto.

Six air holes 39 are formed along a circumference of the cylindrical guider 37 in the guide cover 7.

Figure 6:
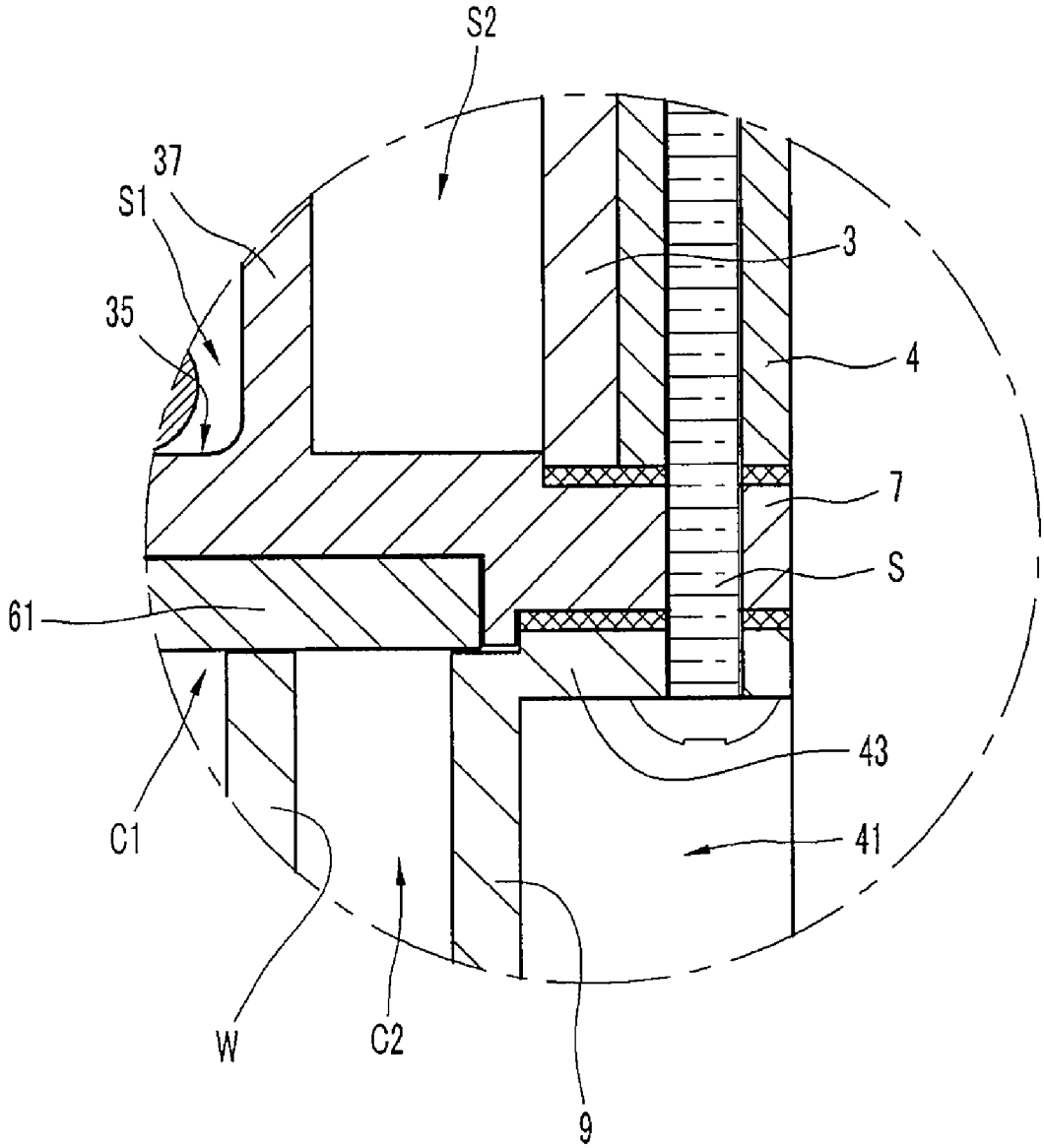
FIG. 6 is an enlarged cross-sectional view of a "D" portion in FIG. 3.

The lower housing 9 as well as the guide cover 7 are engaged to the lower portion of the upper housing 3. The lower housing 9, as shown in FIG. 6, has a cylindrical shape that is opened upwardly, and a mounting end 43 integrally formed with a mounting groove 41 formed inwardly is formed at an upper exterior circumference of the lower housing 9 such that the lower housing 9 as well as the guide cover 7 is engaged to a lower portion of the screw engaging portions 4 of the upper housing 3 by six screws S.

A barrier rib W for partitioning into an inner chamber C1 and an outer chamber C2 is provided in the lower housing 9 so as to form a predetermined negative pressure in the inner chamber C1 and the outer chamber C2. In addition, check valves CV corresponding respectively to the inner chamber C1 and the outer chamber C2 are formed at the lower surface of the lower housing 9.

Figure 5:
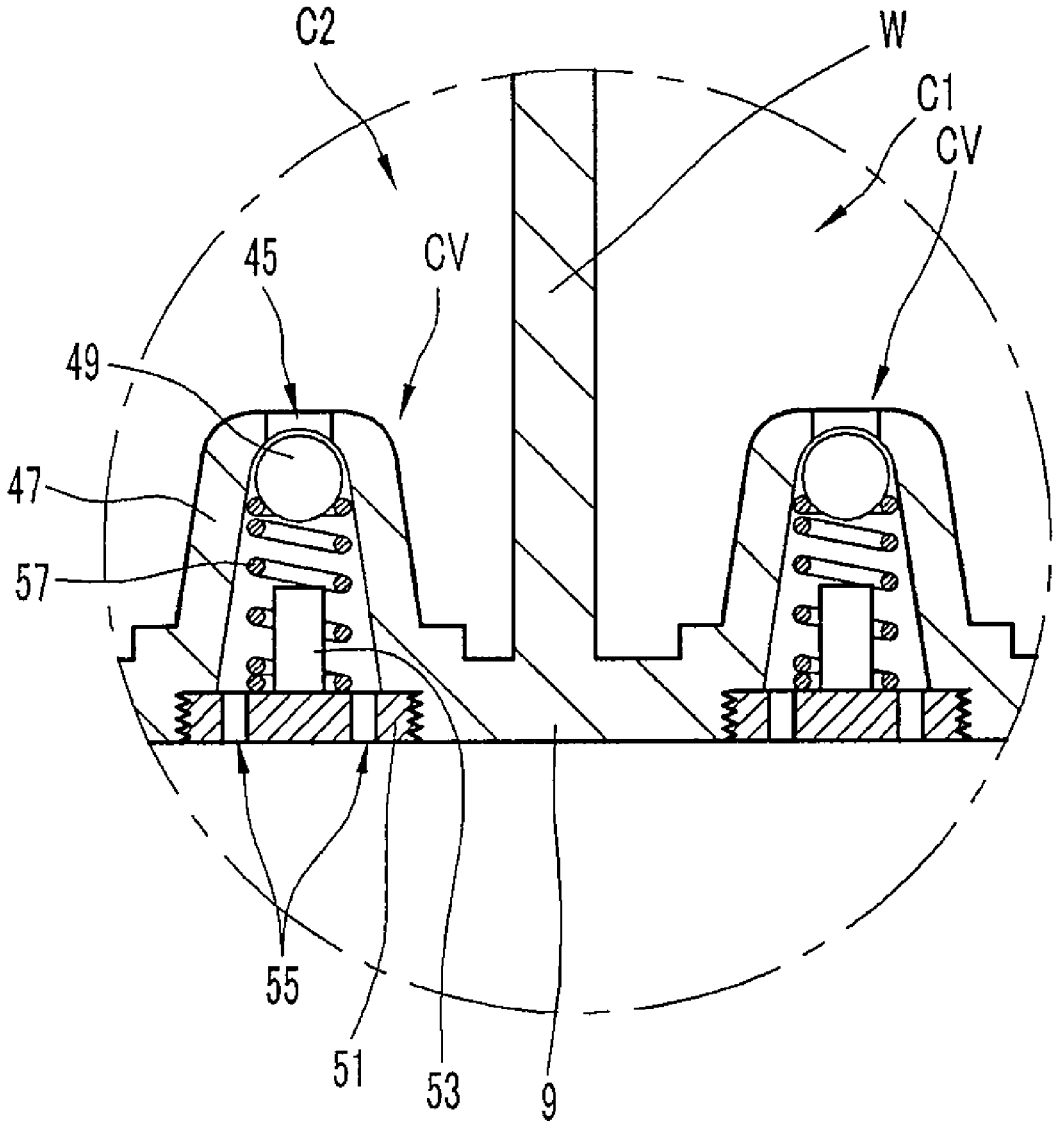
FIG. 5 is an enlarged cross-sectional view of a "C" portion in FIG. 3.

The respective check valves CV, as shown in FIG. 5, include a valve housing 47 and a check ball 49. The valve housing 47 forms an outlet 45 toward the inside of the lower housing 9 and is integrally formed with the lower housing 9, and the check ball 49 is inserted in the valve housing 47 corresponding to the outlet 45.

In addition, a valve cover 51 is engaged to a lower portion of the valve housing 47. The valve cover 51 includes a supporting protrusion 53 integrally formed at a middle portion thereof and supporting the check ball 49 and a penetration hole 55 formed therein.

Further, a valve spring 57 for supporting the check ball 49 toward the outlet 45 with respect to the valve cover 51 is inserted in the valve housing 47.

A sealing tube 59 is inserted in the lower housing 9 and the guide cover 7. The sealing tube 59 is a rubber tube with a bellows shape, and opens upwardly. An upper end of the sealing tube 59 as well as the storage battery case 25 are sealingly engaged to the socket housing 19 of the slider 5 through the penetration hole 33 of the guide cover 7 by four screws S.

That is, the sealing tube 59, as shown in FIG. 2, has an extended end 61 formed at one side of an external circumference thereof and insertedly mounted between the barrier rib W of the lower housing 9 and the lower surface of the guide cover 7, and an air pathway 63 is formed along an edge of the extended end 61 corresponding to the air hole 39 of the guide cover 7.

The sealing tube 59 is divided into an upper tube portion T1 and a lower tube portion T2. The upper tube portion T1 is disposed in the cylindrical guider 37 of the guide cover 7, and has an upper end sealingly mounted at the socket housing 19 of the slider 5 together with the storage battery case 25.

The lower tube portion T2 is integrally formed with a lower portion of the upper tube portion T1 and is disposed in the inner chamber C1 of the lower housing 9. The lower tube portion T2 has a wider width than the upper tube portion T1.

The extended end 61 is formed at one side of the external circumference where the upper tube portion T1 and the lower tube portion T2 are connected so as to be insertedly mounted between the upper end of the barrier rib W and the lower surface of the guide cover 7.

A spring 65 is disposed in the upper housing 3. The spring 65 is interposed between the lower surface of the socket housing 19 and the spring support surface 35 of the cylindrical guider 37, and exerts elastic restoring force on the slider 5.

The spring 65 may be a coil spring. A lower end of the spring 65 is supported by the spring support surface 35, and an upper end of the spring 65 is supported by a pad 67 mounted at the lower surface of the socket housing 19.

Meanwhile, light emitting means are disposed on the slider 5. The light emitting means supply electric power charged in a solar cell module 69 to a light emitting element 71, and emit light to the exterior through the transparent cover 27.

The light emitting means include the solar cell module 69, the light emitting element 71, and an illuminance meter 73.

That is, the solar cell module 69 includes four storage batteries 75 mounted in the storage battery case 25 that is mounted in the socket housing 19 of the slider 5, a solar panel 77 disposed on the slider 5 and charging the storage battery 75 by using solar energy, and a control circuit board 79 controlling charging of the storage battery 75 and supplying electric power generated in the solar panel 77 to the storage battery 75.

A plurality of light emitting elements 71 include three LEDs that are mounted on a middle portion of the solar panel 77. The three LEDs are configured to emit light in different directions from each other. The illuminance meter 73 is mounted at one side of the upper surface of the solar panel 77 and is electrically connected to the control circuit board 79.

The control circuit board 79 is engaged to one side of the storage battery case 25 by screws S.

The light emitting means control emission of light in the light emitting element 71 according to a signal output from the illuminance meter 73 by using the electric power charged in the storage battery 75.

Figure 7:
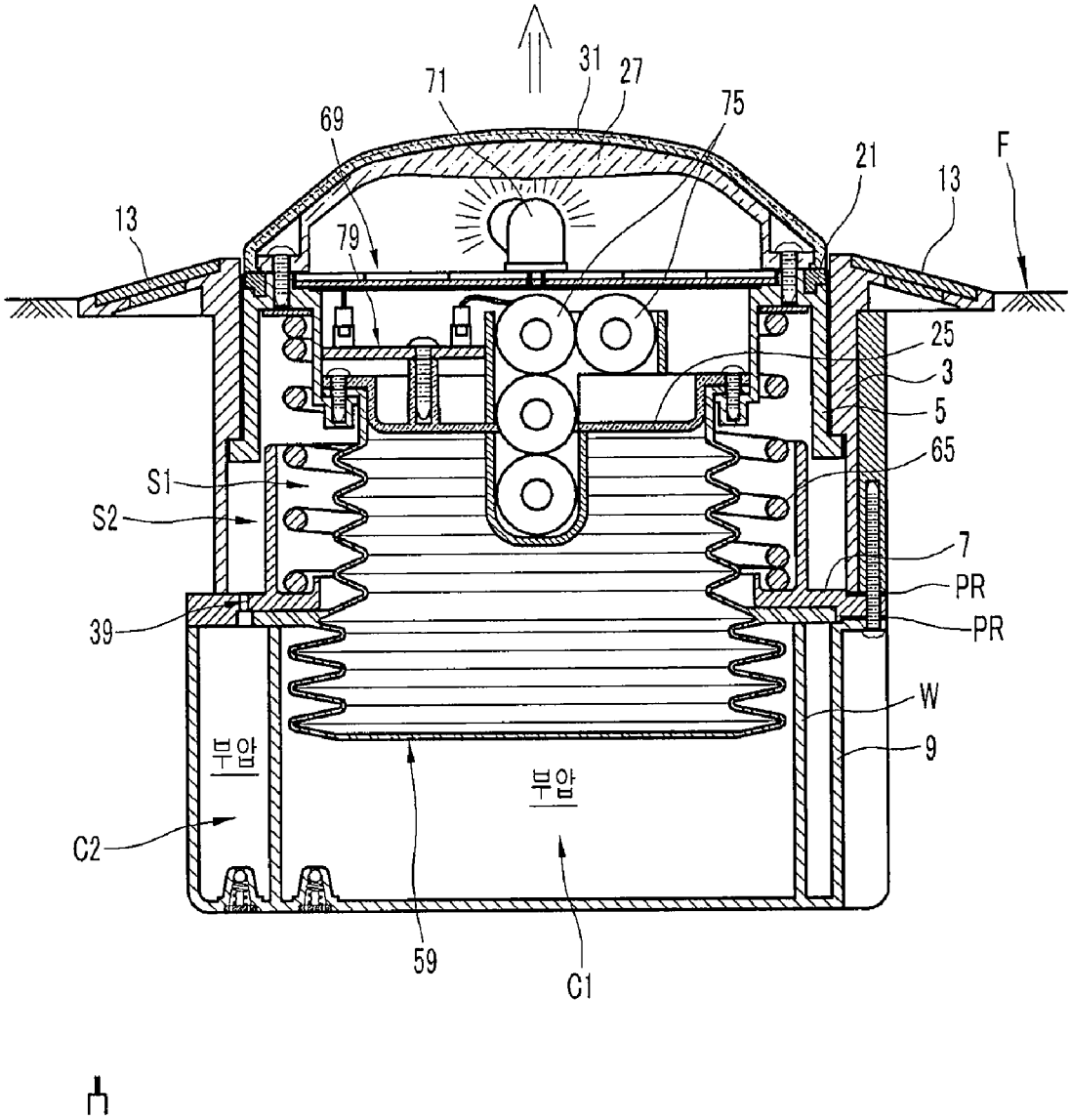
FIG. 7 and FIG. 8 show an operation of a road marker according to the first exemplary embodiment of the present invention.

As shown in FIG. 7, portions of the road marker 1 that are located below the wing portion 11 of the upper housing 3 are laid under the road surface F. In this state, the road marker 1 plays a marking role for identifying a lane on the road in a normal state by reflecting headlights of a vehicle through the reflector 13 and allows a driver to drive safely.

The solar panel 77 generates the electric power by using the solar energy and charges the storage battery 75 in the daytime. The light emitting element 71 emits light according to the signal output from the illuminance meter 73 by using the electric power charged in the storage battery 75 at night. Therefore, the road marker 1 improves its visibility and role for identifying a lane on the road at night.

The road marker 1 according to the first exemplary embodiment of the present invention is laid under the ground in a state that negative pressure is formed in the inner chamber C1 and the outer chamber C2 of the lower housing 9.

That is, in a state that the negative pressure is formed in the respective chambers C1 and C2 by using the check valve CV drawing air out from the inner chamber C1 and the outer chamber C1, the lower housing 9 is completely sealed by injecting adhesive or sealing material into the valve housing 47 of the check valve CV. Therefore, negative pressure formed in respective chambers C1 and C2 is maintained at its initial state.

The negative pressure formed in the inner chamber C1 of the lower housing 9 absorbs an abrupt pressure rise caused by expansion of the lower tube portion T2. At this time, contraction of the lower tube portion T2 occurs by the elastic restoring force of the spring 65.

In addition, the negative pressure formed in the outer chamber C2 of the lower housing 9 absorbs an abrupt pressure rise caused by volume change of a spring operation space S1 and a sliding space S2 that is generated by sliding operation of the slider 5. The negative pressures in the inner chamber C1 and the outer chamber C2 may be set as different values from each other according to the volume change caused by the sliding operation of the slider 5.

Since the lower housing 9 is completely sealed, inflow of water and inner contamination may be prevented, and pressure balance in the upper housing 3 and the lower housing 9 may be maintained. In addition, since the upper tube portion T1 of the sealing tube 59 is ideally contracted, durability of the sealing tube 59 and performance of the seal 21 may be enhanced.

Figure 8:
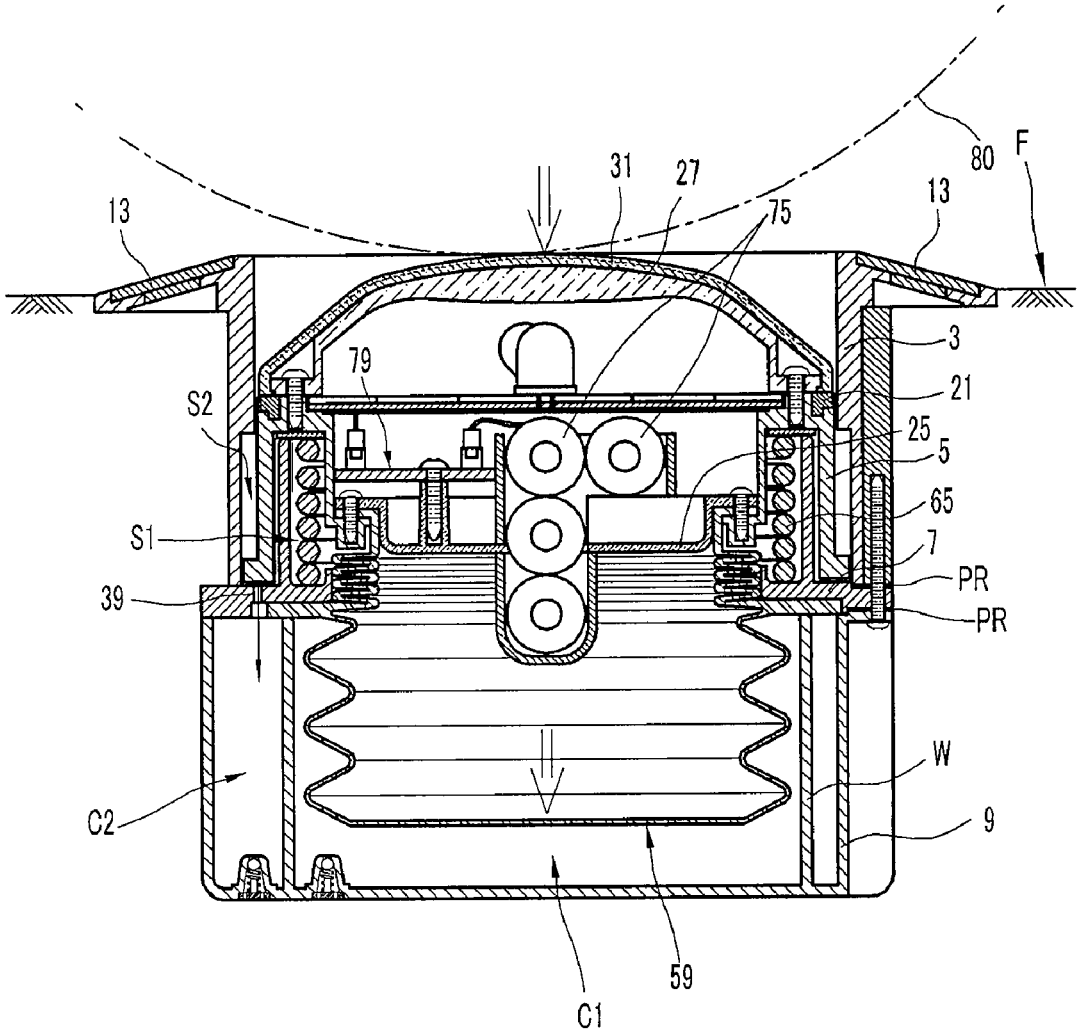

In a case that a tire 80 of a vehicle passes on the road marker 1 as shown in FIG. 8, the slider 5 as well as the transparent cover 27 slide down along the upper housing 3 and the cylindrical guider 37 of the guide cover 7.

At this time, the lower tube portion T2 of the sealing tube 59 is abruptly expanded in the inner chamber C1 of the lower housing 9 and pressure in the inner chamber C1 is raised. However, the negative pressure in the inner chamber C1 absorbs the pressure rise, and thus the lower tube portion T2 is ideally expanded.

As the slider 5 slides down, volume of the spring operation space S1 at which the spring 65 operates and the sliding space S2 at which the slider 5 operates is reduced and pressure in the spaces S1 and S2 is abruptly raised. However, the negative pressure in the outer chamber C2 of the lower housing 9 connected to the spring operation space S1 and the sliding space S2 through the air hole 39 of the guide cover 7 absorbs the pressure rise, and the upper tube portion T1 of the sealing tube 59 is ideally expanded.

Meanwhile, since the transparent cover 27 is completely inserted in the upper housing 3 when the vehicle passes on the road marker 1, the road marker 1 absorbs impact transmitted from the tire 80 by means of elastic force of the spring 65, and reduces impact transmitted to the vehicle body through the tire 80. Therefore, impact felt by a driver may be minimized and stable driving may be realized.

Since the transparent cover 27 as well as the slider 5 is completely inserted in the upper housing 3, vehicle load is not transmitted to the guide cover 7, and thus durability of the road marker 1 may be improved.

According to the first exemplary embodiment of the present invention, the seal 21 mounted between the upper housing 3 and the slider 5 has three contact lines 21*a*, 21*b*, and 21*c* and is mounted at the upper external circumference of the slider 5. Therefore, inflow of water into a gap between the upper housing 3 and the slider 5 may be completely prevented and breakage of the road marker 1 may be prevented.

In addition, since the solar panel 77 is disposed in the transparent cover 27 reinforced by the reinforcing frame 31, the solar panel 77 may be protected from an exterior impact.

According to the first exemplary embodiment of the present invention, exterior impact transmitted from a tire may be absorbed by elastic force of a spring as a consequence of a transparent cover being completely inserted in an upper housing when a vehicle passes on a road marker. Also, vehicle load may not be transmitted to a guide cover and thus breakage of the road marker may be prevented. In addition, since impact felt by a driver may be minimized when the vehicle passes on the road marker, stable driving may be guaranteed.

In addition, maintenance and repair of a reflector may be done easily and thus cost and time may be saved.

Since a light emitting element emits light at night by using electric power charged in a storage battery by solar cell module in the daytime, visibility at night may be improved.

Since the solar panel is disposed in the transparent cover reinforced by a reinforcing frame, breakage of the solar panel by exterior impact may be prevented.

Since a seal mounted between the upper housing and the slider has three contact lines and is mounted at an upper external circumference of the slider, inflow of water to a gap between the upper housing and the slider may be prevented and accordingly breakage of the road marker may be prevented.

Since negative pressure of an inner chamber absorbs an abrupt pressure change caused by expansion and contraction of the sealing tube and negative pressure of an outer chamber absorbs an abrupt pressure change caused by volume change of a spring operation space and sliding space, inflow of water and inner contamination may be prevented and sealing performance may be enhanced.

Hereinafter, the second exemplary embodiment of the present invention will be described in detail, referring to the accompanying drawings.

Figure 9:
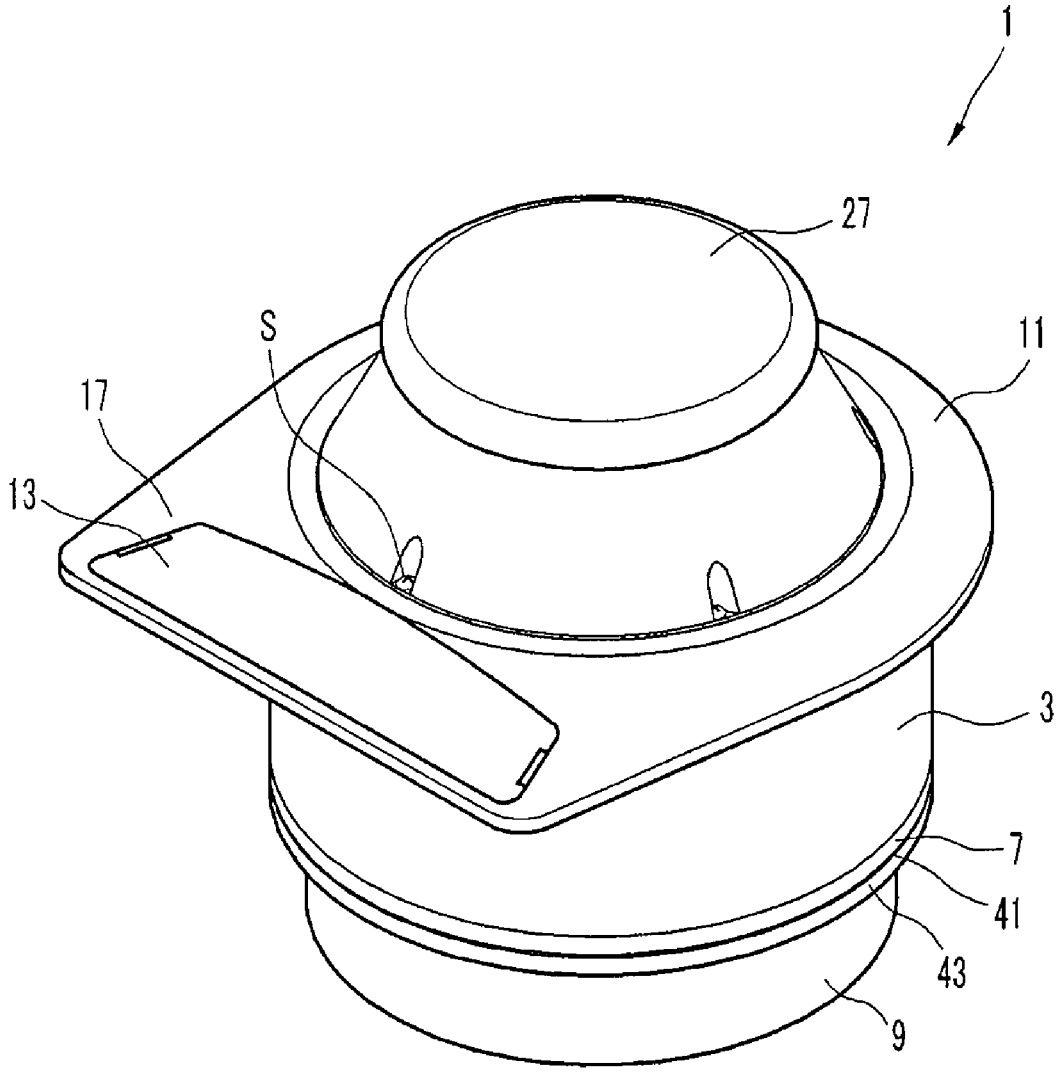
FIG. 9 is a perspective view of a road marker according to the second exemplary embodiment of the present invention.
Figure 10:
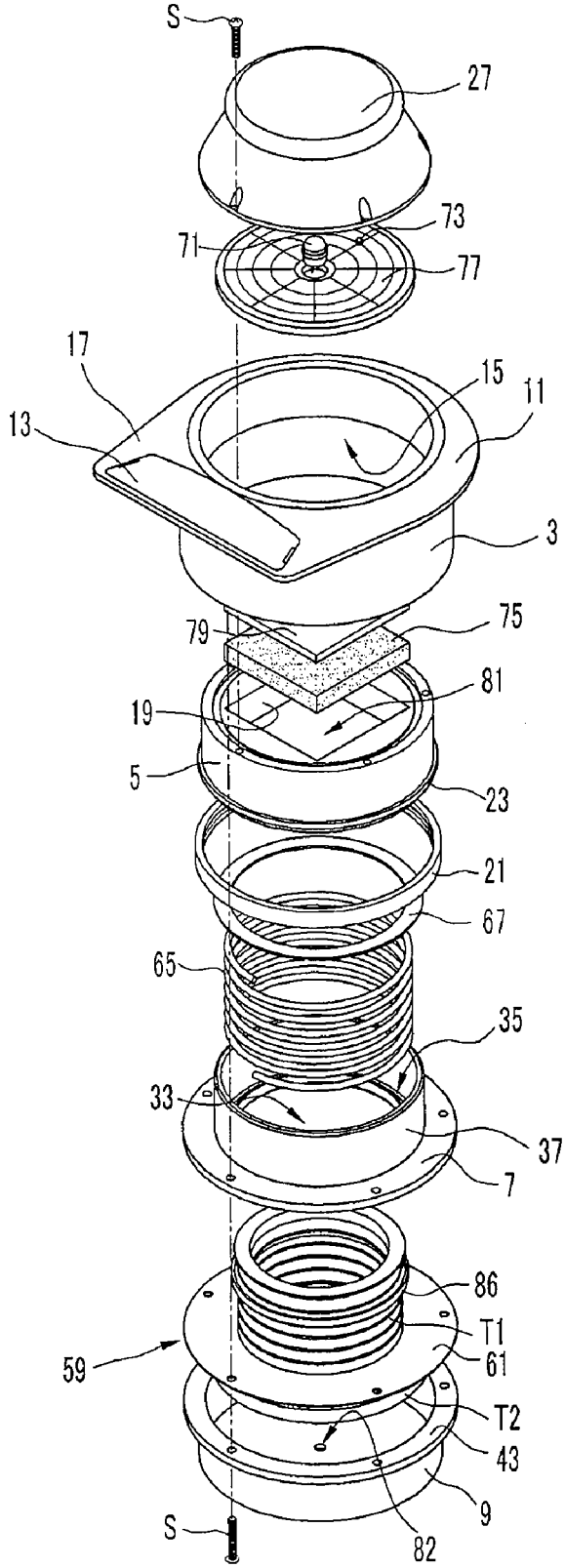
FIG. 10 is an exploded perspective view of a road marker according to the second exemplary embodiment of the present invention.
Figure 11:
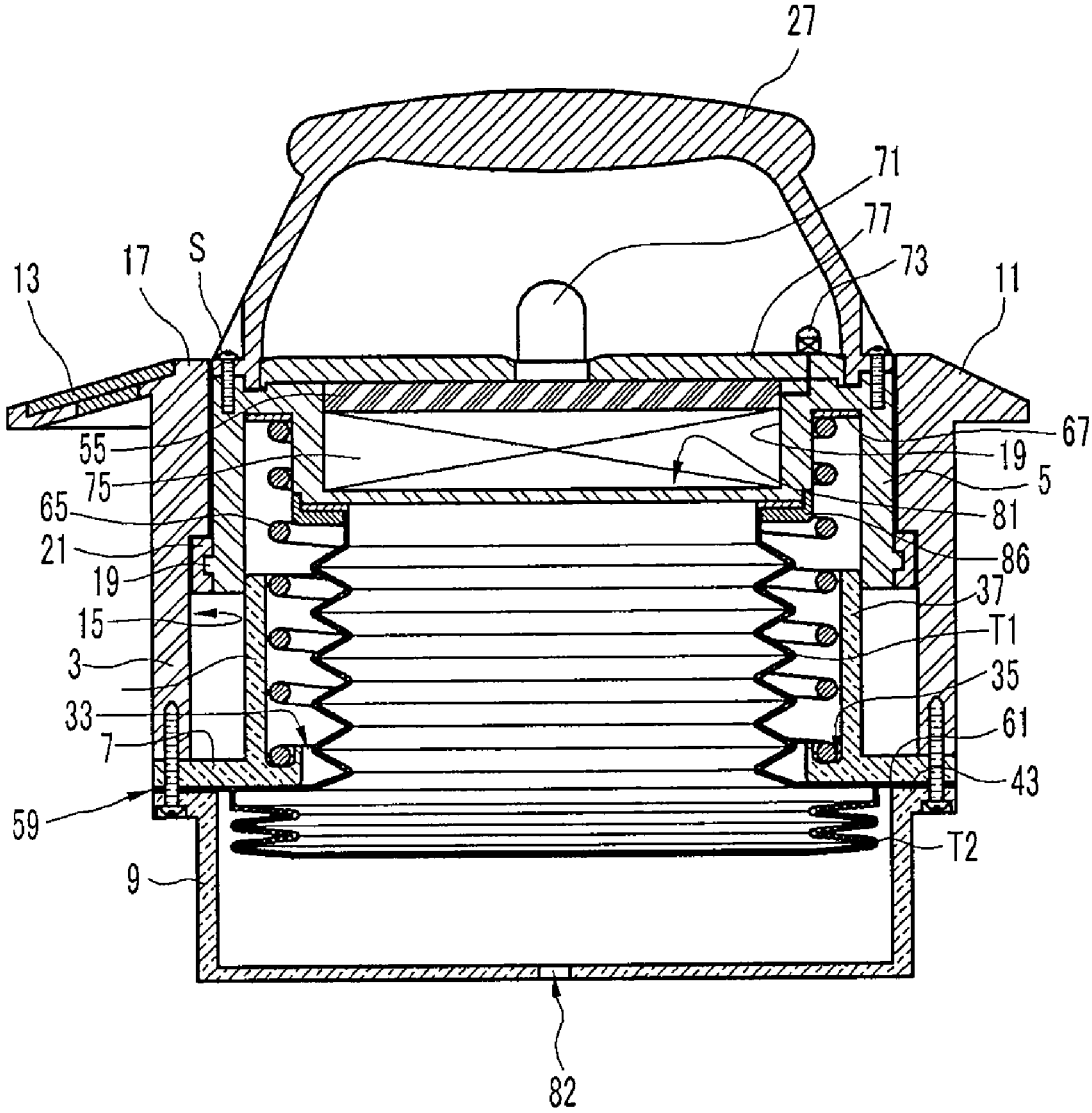
FIG. 11 is a cross-sectional view of a road marker according to the second exemplary embodiment of the present invention.

FIG. 9 is a perspective view of a road marker according to the second exemplary embodiment of the present invention, FIG. 10 is an exploded perspective view of a road marker according to the second exemplary embodiment of the present invention, and FIG. 11 is a cross-sectional view of a road marker according to the second exemplary embodiment of the present invention.

A road marker 1 according to the second exemplary embodiment of the present invention, as shown in FIG. 9 and FIG. 10, includes an upper housing 3 laid under a road surface, a slider 5 sliding upwardly and downwardly in the upper housing 3, a guide cover 7 guiding upward and downward movements of the slider 5, and a lower housing 9 engaged to a lower portion of the upper housing 3.

The upper housing 3, as shown in FIG. 11, has a cylindrical shape. A wing portion 11 in which a reflector 13 is mounted and that is a reference surface is formed at an upper exterior circumference of the upper housing 3, and a guiding surface 15 that is an outward stepped surface from an interior circumference of the upper housing 3 is formed at a lower interior circumference thereof.

The slider 5 has a cylindrical shape that is opened upwardly, and has a stopping protrusion 23 integrally formed with a lower exterior circumference of the slider 5 so as to be guided by the guiding surface 15. Therefore, the slider 5 is inserted in the lower end of the upper housing 3 and slides upwardly and downwardly in the upper housing 3.

A socket housing 19 having a space 81 is formed downwardly at a middle portion of the slider 5.

A seal 21 for maintaining air-tightness between the slider 5 and the guiding surface 15 of the upper housing 3 is insertedly mounted at the stopping protrusion 23 of the slider 5.

In addition, a transparent cover 27 is mounted on the slider 5. The transparent cover 27 is made of transparent plastic materials and has a rounded upper surface. The transparent cover 27 is engaged to an upper circumference of the slider 5 by five screws S.

The guide cover 7 is mounted at a lower portion of the upper housing 3. A penetration hole 33 is formed at a middle portion of the guide cover 7, a spring support surface 35 is formed at a circumferential surface of the penetration hole 33, and a cylindrical guider 37 for guiding the interior circumference of the slider 5 is formed upwardly at an upper surface of the spring support surface 35.

The lower housing 9 is engaged to a lower portion of the upper housing 3. The lower housing 9 has a cylindrical shape opened upwardly, and an air hole 82 is formed at a lower surface of the lower housing 9.

A mounting end 43 is protruded outwardly from an upper surface of the lower housing 9 such that the mounting end 43 as well as the guide cover 7 are engaged to the upper housing 3 by screws S.

That is, the guide cover 7 as well as the lower housing 9 are engaged to the lower surface of the upper housing 3 by five screws S.

A sealing tube 59 is inserted in the lower housing 9 and the guide cover 7. The sealing tube 59 is a rubber tube with a bellows shape, and opens upwardly. An upper end of the sealing tube 59 penetrates through the penetration hole 33 of the guide cover 7 and is sealingly mounted at a lower surface of the socket housing 19 by a mounting ring 86. An extended end 61 is formed at one side of an external circumference thereof so as to be engaged between the mounting end 43 of the lower housing 9 and the lower surface of the guide cover 7 by screws S.

The sealing tube 59 includes an upper tube portion T1 and an lower tube portion T2. The upper tube portion T1 is disposed in the cylindrical guider 37 of the guide cover 7, and has an upper end sealingly mounted at the lower surface of the socket housing 19 by the mounting ring 86.

In addition, the lower tube portion T2 is integrally formed with a lower portion of the upper tube portion T1, and has a wider width than the upper tube portion T1. The lower tube portion T2 is disposed in the lower housing 9, and is provided with the extended end 61 at the side of the external circumference at which the lower tube portion T2 is connected to the upper tube portion T1 such that the extended end 61 is engaged between the mounting end 43 of the lower housing 9 and the lower surface of the guide cover 7.

A spring 65 is disposed in the upper housing 3. The spring 65 is interposed between the lower surface of the socket housing 19 and the spring support surface 35 of the cylindrical guider 37, and exerts elastic restoring force on the slider 5.

The spring 65 may be a coil spring. A lower end of the spring 65 is supported by the spring support surface 35, and an upper end of the spring 65 is supported by a pad 67 mounted at the lower surface of the socket housing 19.

Meanwhile, light emitting means are disposed on the slider 5. The light emitting means supply electric power charged in a solar cell module 69 to a light emitting element 71, and emit light to the exterior through the transparent cover 27.

That is, the light emitting means include a storage battery 75 mounted in the space 81 and a control circuit board 79 disposed on the storage battery 75.

A solar panel 77 for generating electric power by using solar energy and charging the storage battery 75 is mounted on the socket housing 19 of the slider 5.

In addition, the light emitting element 71 is mounted on the control circuit board 79.

An LED is preferably used as the light emitting element 71.

In addition, an illuminance meter 73 is mounted at one side of the upper surface of the solar panel 77, and is electrically connected to the control circuit board 79.

Figure 12:
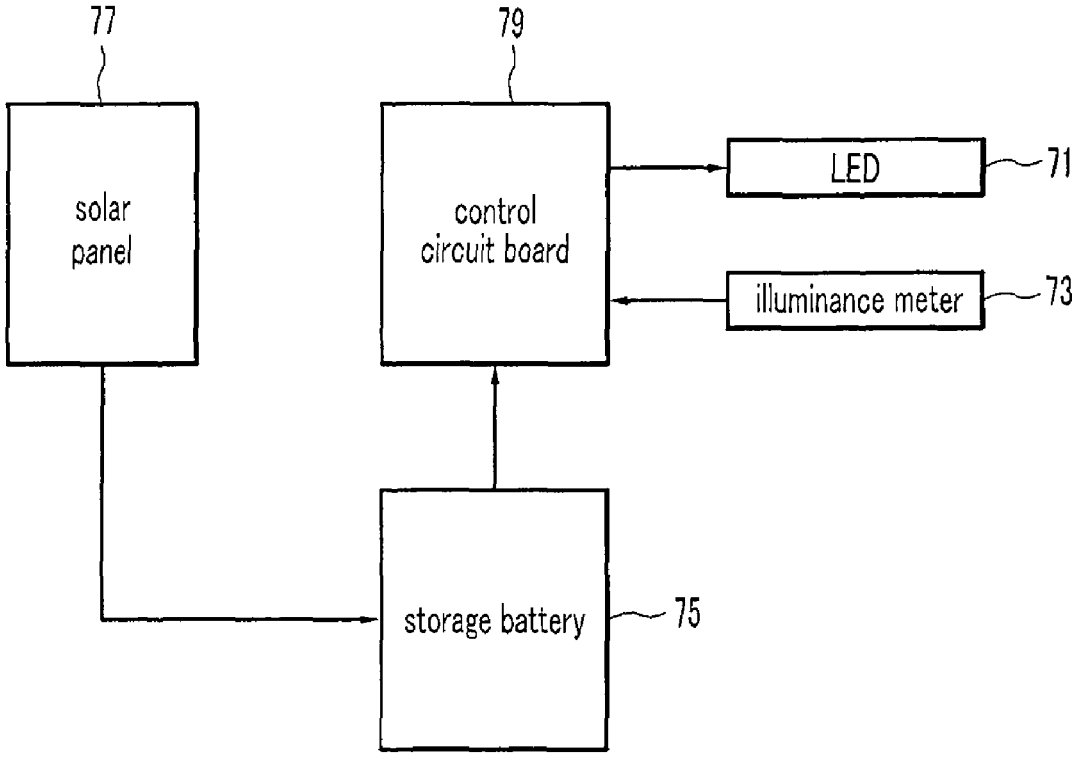
FIG. 12 is a control block diagram of a road marker according to the second exemplary embodiment of the present invention.

The light emitting means, as shown in FIG. 12, control the light emitting element 71 according to a signal output from the illuminance meter 73 by using the electric power charged in the storage battery 75.

According to the second exemplary embodiment of the present invention, exterior impact is absorbed by elastic force of a spring, and accordingly, breakage of a road marker is prevented. In addition, impact felt by a driver when a vehicle passes on the road marker is minimized, and thus stable driving may be guaranteed.

In addition, maintenance and repair of a reflector may be done easily and thus cost and time may be saved.

Since a light emitting element emits light at night by using electric power charged in a storage battery by solar cell module in the daytime, visibility at night may be improved.

Since a seal is mounted between an upper housing and a slider and a sealing tube of a bellows type is provided in the upper housing, air-tightness may be maintained and inflow of water may be prevented. Therefore, breakage of the road marker may be prevented.

Since a solar panel is provided in a transparent cover, the solar panel may not be destroyed.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A road marker comprising:

an upper housing having a cylindrical shape, and having a wing portion formed along an upper exterior circumference thereof and receiving a reflector and a guiding surface formed as a stepped surface from a lower interior circumference thereof;

a slider having a cylindrical shape, and having a socket housing disposed inside thereof and integrally formed with an upper end thereof, a seal mounted along an upper exterior circumference thereof and contacting an interior circumference of the upper housing, and a stopping protrusion formed along a lower exterior circumference thereof so as to be guided along the guiding surface, the slider being inserted into and being slidably mounted in the upper housing;

a storage battery case mounted in the socket housing;

a transparent cover comprising a rounded upper surface and a frame insert groove having a predetermined shape and formed along the upper surface thereof, the transparent cover being engaged to an upper circumference of the slider;

a reinforcing frame having a predetermined shape and insertedly mounted in the frame insert groove of the transparent cover;

a guide cover disposed at a lower portion of the upper housing, and having a penetration hole formed at a middle portion thereof, a cylindrical guider formed upwardly at an upper circumference of the penetration hole and guiding the interior circumference of the slider, and a plurality of air holes formed along a circumference of the cylindrical guider;

a lower housing having a cylindrical shape opened upwardly, and having a mounting end integrally formed with a mounting groove formed inwardly at an upper exterior circumference thereof so as to be engaged to the lower portion of the upper housing together with the guide cover, a barrier rib formed therein and partitioned into an inner chamber and an outer chamber in which a predetermined negative pressure is generated, and check valves corresponding respectively to the inner chamber and the outer chamber mounted at a lower surface thereof;

a sealing tube formed as a rubber tube with a bellows shape, and having an upper end sealingly mounted at the socket housing of the slider together with the storage battery case through the penetration hole of the guide cover, an extended end formed at one side of an external circumference thereof and insertedly mounted between the lower housing and the lower surface of the guide cover, and an air pathway formed along an edge of the extended end and corresponding to the air hole;

a spring, in the upper housing, interposed between the lower surface of the socket housing and a spring support surface in the cylindrical guider of the guide cover, and exerting elastic restoring force on the slider; and light emitting means mounted on the slider, supplying electric power charged in a solar cell module to a light emitting element, and emitting light to the exterior through a transparent cover.

2. The road marker of claim 1, wherein the reflector has a surface with high luminance and reflection characteristics, and is mounted on extended portions formed respectively at both sides of the wing portion corresponding to a driving direction of a vehicle.

3. The road marker of claim 1, wherein the seal has three contact lines formed along the exterior circumference thereof, and contacts the interior circumference of the upper housing.

4. The road marker of claim 1, wherein a sliding stroke of the slider is longer than the height of the transparent cover.

5. The road marker of claim 1, wherein an air gap for passing air is formed between the exterior circumference of the cylindrical guider and the interior circumference of the slider corresponding thereto.

6. The road marker of claim 1, wherein the reinforcing frame comprises:

a circular ring portion insertedly mounted in the exterior circumference of the transparent cover; and a frame portion integrally connected to the ring portion and insertedly mounted in the frame insert groove formed across the upper surface of the transparent cover.

7. The road marker of claim 1, wherein the check valve comprises:

a valve housing having an outlet formed toward the inside of the lower housing;

a check ball inserted in the valve housing corresponding to the outlet;

a valve cover engaged to a lower portion of the valve housing, and having a supporting protrusion integrally formed at a middle portion thereof and supporting the check ball, and a penetration hole formed therein; and a valve spring, in the valve housing, supporting the check ball toward the outlet with respect to the valve cover.

8. The road marker of claim 1, wherein the sealing tube comprises:

an upper tube portion disposed in the cylindrical guider of the guide cover, an upper end of the upper tube portion being sealingly mounted to the socket housing of the slider together with the storage battery case; and a lower tube portion integrally formed with a lower portion of the upper tube portion, disposed in the inner chamber of the lower housing, and having an extended end formed at one side of the external circumference thereof connected to the upper tube portion so as to be insertedly mounted between an upper end of the barrier rib in the lower housing and a lower surface of the guide cover, the lower tube portion having a wider width than the upper tube portion.

9. The road marker of claim 1, wherein the light emitting means comprises:

the solar cell module having a plurality of storage batteries mounted in the storage battery case, and a control circuit disposed at the upper end of the slider and charging the storage battery by using solar energy;

a plurality of light emitting elements mounted at a middle upper surface of the solar cell module and emitting light according to a control signal; and an illuminance meter mounted at one side of the upper surface of the solar cell module, detecting illuminance, and outputting a signal corresponding thereto to the solar cell module.

10. A road marker comprising:

an upper housing having a cylindrical shape, and having a wing portion formed along an upper exterior circumference thereof and receiving a reflector and a guiding surface formed as a stepped surface from a lower interior circumference thereof;

a slider having a cylindrical shape having an opened upper surface, and having a stopping protrusion formed along a lower exterior circumference and guiding the guiding surface, and a socket housing formed at a middle portion thereof and having a space so as to be inserted into and slidably mounted in the upper housing;

a transparent cover having a rounded upper surface and engaged to an upper circumference of the slider;

a guide cover disposed at a lower portion of the upper housing, and having a penetration hole formed at a middle portion thereof and a cylindrical guider formed upwardly at an upper circumference of the penetration hole and guiding the interior circumference of the slider;

a lower housing having a cylindrical shape opened upwardly, and having an air hole formed at a lower surface thereof and a mounting end protruded outwardly along an upper circumference so as to be engaged to the lower end of upper housing together with the guide cover;

a sealing tube formed as a rubber tube with a bellows shape opened upwardly, and having an upper end sealingly mounted at the lower surface of the socket housing through the penetration hole of the guide cover by means of a mounting ring and an extended end formed at one side of the external circumference thereof and engaged between the mounting end of the lower housing and the lower surface of the guide cover;

a spring, in the upper housing, interposed between the lower surface of the socket housing and an upper surface of the cylindrical guider, and exerting elastic restoring force on the slider; and light emitting means mounted on the slider, supplying electric power charged by using solar energy to a light emitting element, and emitting light to the exterior through the transparent cover.

11. The road marker of claim 10, wherein the sealing tube comprises:

an upper tube portion disposed in the cylindrical guider of the guide cover and having an upper end sealingly mounted at the lower surface of the socket housing through the mounting ring; and a lower tube portion integrally formed with a lower portion of the upper tube portion, disposed in the lower housing, and having the extended end formed at one side of the external circumference thereof connected to the upper tube portion so as to be engaged between the mounting end of the lower housing and the lower surface of the guide cover.

12. The road marker of claim 10, wherein the light emitting means comprises:

a storage battery mounted at the space in the socket housing of the slider;

a control circuit board disposed in the space of the socket housing and disposed at an upper portion of the storage battery;

a solar panel mounted at an upper portion of the socket housing and charging the storage battery by using the solar energy;

the light emitting element mounted on the control circuit board through the solar panel; and an illuminance meter mounted at one side of the upper surface of the solar panel, detecting illuminance, and outputting a signal corresponding thereto to the control circuit board.

13. The road marker of claim 10, wherein the reflector has a surface with high luminance and reflection characteristics, and is mounted through extended portions formed at the wing portion corresponding to a driving direction of a vehicle.

14. The road marker of claim 10, wherein a seal is mounted at the stopping protrusion of the slider for maintaining airtightness between the stopping protrusion and the guiding surface of the upper housing.

15. The road marker of claim 10, wherein the spring is disposed in the cylindrical guider of the guide cover, and has a lower end supported by the upper surface of the guide cover and an upper end supported by the lower surface of the slider.

* * * * *